US005816030A

United States Patent [19]

Carlberg et al.

[11] Patent Number: 5,816,030

[45] Date of Patent: Oct. 6, 1998

[54] APPARATUS FOR PACKAGING CUT STRIPS

[75] Inventors: David L. Carlberg; Dennis L. May; Theodore V. Meigs, all of Twain Harte, Calif.

[73] Assignee: Kinematic Automation, Inc., Twain Harte, Calif.

[21] Appl. No.: 931,318

[22] Filed: Sep. 16, 1997

[51] Int. Cl.[6] ..... B65B 63/00

[52] U.S. Cl. ..... 53/520; 53/236; 53/540

[58] Field of Search ..... 53/148, 152, 236, 53/520, 540

[56] References Cited

U.S. PATENT DOCUMENTS

| | | | |
|---|---|---|---|
| 4,558,577 | 12/1985 | Kuehfuss | 53/520 X |
| 4,939,888 | 7/1990 | Katz et al. | 53/520 X |
| 4,965,983 | 10/1990 | Muller et al. | 53/520 X |
| 5,067,309 | 11/1991 | Carlberg et al. . | |

*Primary Examiner*—Daniel Moon
*Attorney, Agent, or Firm*—Harris Zimmerman

[57] ABSTRACT

A method and apparatus for collecting and packaging a plurality of strips of a web material operates in conjunction with a rotary cutter assembly which forms a plurality of strips in parallel, longitudinally spaced array. A platen includes an intake portion with a plurality of inclined surfaces extending longitudinally in parallel array away from the cutter assembly, the inclined surfaces being stepped to capture the strips. A fixed top plate extends above the intake portion of the platen, and is provided with steps formed in complementary fashion to the platen steps to retain the cut strips therebetween. The strips are moved longitudinally along their respective steps to a collection portion of the platen. A movable top plate disposed above the collection portion translates longitudinally to expose the strips on the collection portion. A scoop assembly includes a strip scoop comprising a housing having a hemi-cylindrical collection chamber extending longitudinally therein, the chamber having opposed open ends and a movable shutter at one of the ends. A pair of spaced apart tines extend contiguously with the hemi-cylindrical sidewall, and are spaced to selectively engage parallel slots extending laterally in the collection portion of the platen. A container packing station disposed at like ends of the channels includes a plunger having a disk-like head and a narrow shaft which is driven longitudinally to extend and push the strips from the collection chamber into a bottle or similar container. The scoop assembly translates vertically before the plunger is retracted, the plunger shaft passing through the lower opening of the collection chamber.

24 Claims, 9 Drawing Sheets

APPARATUS FOR PACKAGING CUT STRIPS

BACKGROUND OF THE INVENTION

The present invention generally relates to method and apparatus for collecting uniform strips of homogeneous web material and packaging the strips.

Many medical, chemical and biological diagnostic tests and assays for laboratory and home use have been reduced to an optimally simple routine: immerse a test strip or stick into a liquid, and observe the change in color of the test strip or stick to read the results of the test. Tests that formerly required days of laboratory work may now be carried out in seconds, with a reliability factor that exceeds former, more time-consuming methods. Generally speaking, the strips or sticks (hereinafter, "strips") comprise long, narrow pieces of paper, plastic, laminates, or similar sheet material that carries a highly specific reagent, reactant, or assay compound uniformly distributed in the sheet material.

The sheet material may be manufactured in large amounts, generally as long webs of the sheet material wound on spools to form a compact roll. The roll is fabricated into the test strips using a strip cutter assembly, which comprises two cutter spindle assemblies, each having a plurality of cutting disks secured in longitudinally spaced relationship. The disks of the adjacent cutter assemblies are disposed in paired relationship, each pair being closely adjacent with overlapping peripheral edges. The cutter assemblies are driven to rotate, so that the web material passing therethrough is severed into a large plurality of strips in one operation. The strips are received on a platen that is stepped laterally so that each strip falls onto a respective step, and the platen is disposed to catch the strips issuing from the cutter assembly. Thereafter the strips are translated perpendicularly away from the cutter assembly to engage a collection assembly. The collection assembly is driven laterally to impinge on the strips laterally in series and cause the strips to accumulate in a cascaded stack. Vacuum may be applied to the platen to secure the strips by suction and maintain alignment while the platen is translated and the stack is being formed by the scooper assembly. The stack is delivered to a packing assembly which places the stack into a container that is later sealed.

Although the process of forming and packing the test strips appears to be simple and straightforward in description, it is more problematic in practice. The strips of web material are rather low in mass, particularly in comparison to the surface area of the strips, and the strips are highly resilient and elastic. These physical properties cause the strips to fall erratically on the platen, causing alignment problems and poor stacking.

Moreover, the cutting process can introduce electrostatic charges to the strips, which are typically highly dielectric, by separating differentially charged portions of the web material. The rotating disk knives can exacerbate this effect by adding a Van de Graf effect and depositing further electrostatic charge on the passing strips. The resulting static charges can overwhelm the vacuum suction and the mass inertia of the strips and cause them to fly off the platen or out of the cascaded stack, particularly as electrostatic repulsion increases with the square of the proximity of the strips. The consequences of the electrostatic forces can be erratic packaging, jamming of the machines, loss of product count in each package, and other quality control problems.

SUMMARY OF THE INVENTION

The present invention generally comprises a method and apparatus for collecting and packaging a large plurality of strips of a web material. The invention overcomes the drawbacks of the prior art through a unique mechanism and sequence of steps to carry out the invention.

The apparatus of the invention operates in conjunction with a cutter assembly comprising paired disk cutters in longitudinal array to form a plurality of strips in parallel, longitudinally spaced array. A platen is mounted stationary and adjacent to the cutter assembly, the platen including an intake portion having a finger-like projection to receive the strips as they issue from the cutter assembly. The projection is provided with a plurality of inclined surface, and the inclined surfaces extend longitudinally in parallel array away from the cutter assembly, the inclined surfaced being stepped and spaced apart so that each strip is captured on a respective one of the inclined surfaces. A fixed top plate extends above the intake portion of the platen, and is provided with steps formed in complementary fashion to the platen steps to retain the cut strips therebetween.

The strips are then moved longitudinally along their respective steps to a collection portion of the platen. A movable top plate is disposed above the collection portion, and is provided with steps formed in complementary fashion to the platen steps to retain the cut strips therebetween. An actuator connected to the movable top plate selectively translates the movable top plate longitudinally to expose the strips on the collection portion of the platen. The collection portion includes a pair of parallel channels extending laterally across the steps thereof to permit engagement and operation of a scoop assembly.

The scoop assembly includes a mechanism to drive a strip scoop reciprocally to retrieve all of the strips in a single pass, and to deposit the stack in a bottle packing station disposed at one end of the platen. The strip scoop comprises a housing having a collection chamber extending longitudinally therein, the chamber having opposed open ends and a movable shutter at one of the ends. The collection chamber including an upper portion having a hemi-cylindrical sidewall and a lower portion that is substantially open. A pair of spaced apart tines are formed contiguously with the hemi-cylindrical sidewall, and extend partially across the lower opening of the collection chamber. The tines are spaced apart to selectively engage the parallel slots of the collection portion of the platen.

The strip scoop is driven to traverse the collection portion of the platen, the tines cascading the strips one atop the next from the stepped platen until all of the strips are picked up and held in the collection chamber. At the end of the traverse, the strip scoop arrives at a container packing station and impinges on a stop that opens the shutter of the scoop, whereby both ends of the chamber are open and the strips may be discharged longitudinally from the collection chamber. The packing station includes a plunger having a disk-like head and a narrow shaft, and is driven longitudinally to extend and push the strips from the collection chamber into a bottle or similar container. The bottle is then sealed in a further operation.

The scoop assembly includes a vertically mounted pneumatic lift cylinder which is actuated to raise the strip scoop before it traverses the platen retrograde to return to the starting position, there to await the next batch of strips to be moved onto the rear platen portion. The vertical translation occurs before the plunger is retracted, the plunger shaft passing through the lower opening of the collection chamber. As the scoop assembly is raised vertically, the movable top plate returns over the collection portion of the platen, and another batch of strips is delivered to the collection portion. As the scoop assembly returns to the starting position, the shutter impinges on a bracket that drives the shutter to close. Thereafter the scoop assembly is translated vertically downwardly, and is thus positioned to begin another collection cycle.

DESCRIPTION OF THE PREFERRED EMBODIMENT

The present invention generally comprises a method and apparatus for collecting and packaging a large plurality of strips of a web material. Such strips may comprise diagnostic test strips for medical, chemical, and biological tests and assays.

Figure 4:
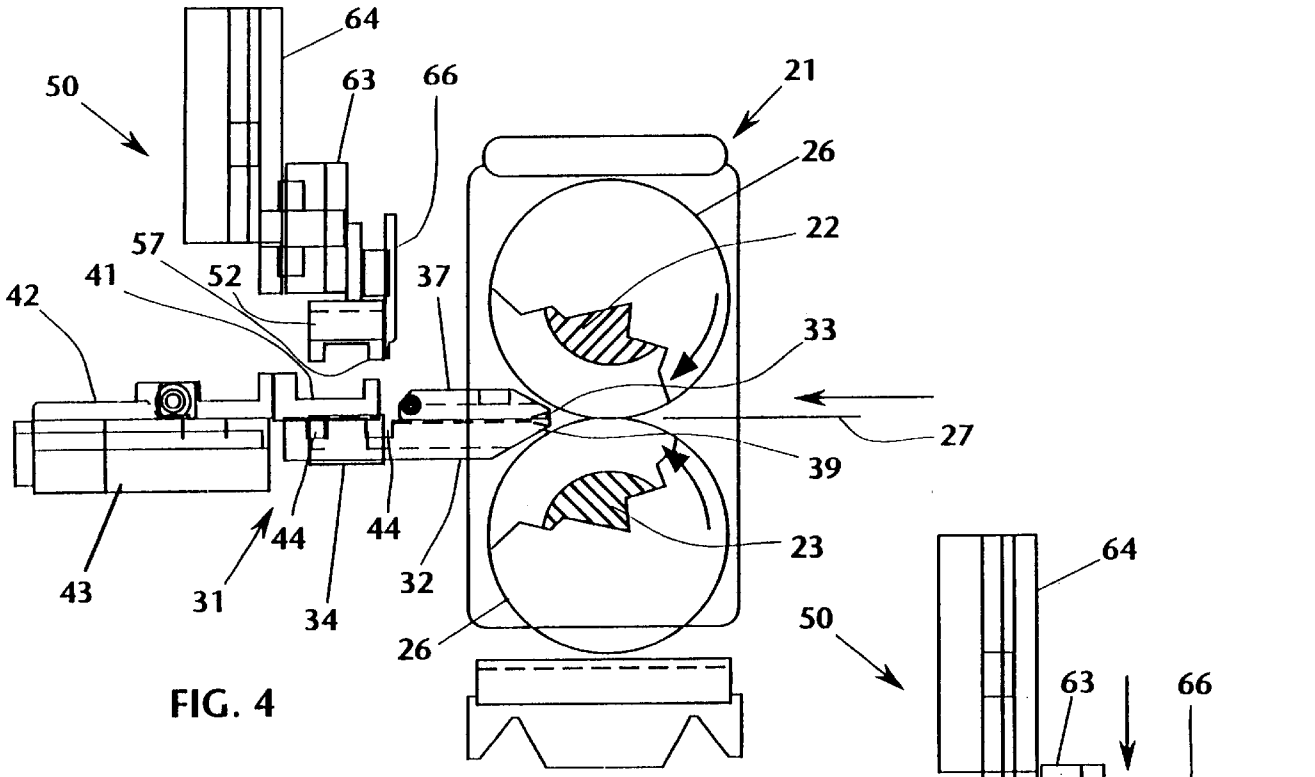
FIG. 4 is an end elevation of the apparatus of the present invention, shown in relation to a rotary strip cutting assembly, with the top containment device extended and the scoop assembly raised vertically.

With regard to FIG. 4, the apparatus of the invention is adapted to operate in conjunction with a rotary cutter assembly 21 for forming a plurality of strips from a rectangular, planar card or roll stock. The cutter assembly 21 includes a pair of spindles 22 and 23, each having a rotatable arbor and a plurality of disk blades 26 equally spaced longitudinally therealong. The spindles 22 and 23 are driven to counterrotate, whereby a card 27 introduced into the converging disk blades as shown will be formed in a single pass into a plurality of strips of uniform width and length. Each strip is discharged from the cutter assembly with a slight angular displacement about the longitudinal axis of the strip, due to the staggered, overlapping disk blades.

The apparatus further includes a platen assembly 31, shown in FIGS. 1–10 for receiving the strips from the cutter assembly 21. The platen assembly 31 includes an intake portion 32 and a rear portion 34, as shown in FIG. 4. The intake portion 32 extends toward the cutter assembly 21 and includes a projection 33 disposed to receive directly the strips issuing from the cutter 21. As shown for example in FIGS. 6–10, the platen assembly is provided with a plurality of inclined surfaces 36, the inclined surfaces 36 extending longitudinally in parallel array away from the cutter assembly. The inclined surfaces 36 are stepped and spaced apart so that each strip is captured on a respective one of the inclined surfaces. (The rotary cutting blade set imparts a slight rotation to each strip about its longitudinal axis, and the inclined surfaces are offset at the appropriate angle so that the strips land on the inclined surfaces in flush relationship thereto.)

A fixed top containment assembly 37 is disposed in vertically adjacent, closely spaced fashion to the front platen portion. The assembly 37 is provided with a plurality of stepped surfaces 38 extending in complementary stepped fashion to the surfaces 36 and spaced apart therefrom to receive a respective strip between corresponding adjacent surfaces 36 and 38. The gap between each set of corresponding adjacent surfaces 36 and 38 includes a flared end 39 to define a wide vertical acceptance angle for the strips issuing from the cutter assembly 21.

The inclined surfaces 36 extend contiguously to the rear platen portion 34, although the top containment does not extend to the rear platen portion. Rather a movable top containment plate 41 is disposed vertically adjacent to the rear platen portion 34, and is provided with stepped surfaces formed similarly to the surfaces 38. The top containment plate 41 is supported by a longitudinally translatable slide 42 coupled to a linear actuator 43. Thus the top containment plate 41 may be translated selectively and reciprocally from the position depicted in FIGS. 1 and 4, in which the plate 41 is directly vertically adjacent to the rear platen portion 34, to the position depicted in FIGS. 2, 3, and 5, in which the top plate 41 is retracted to completely disengage the rear platen 34.

Figure 14:
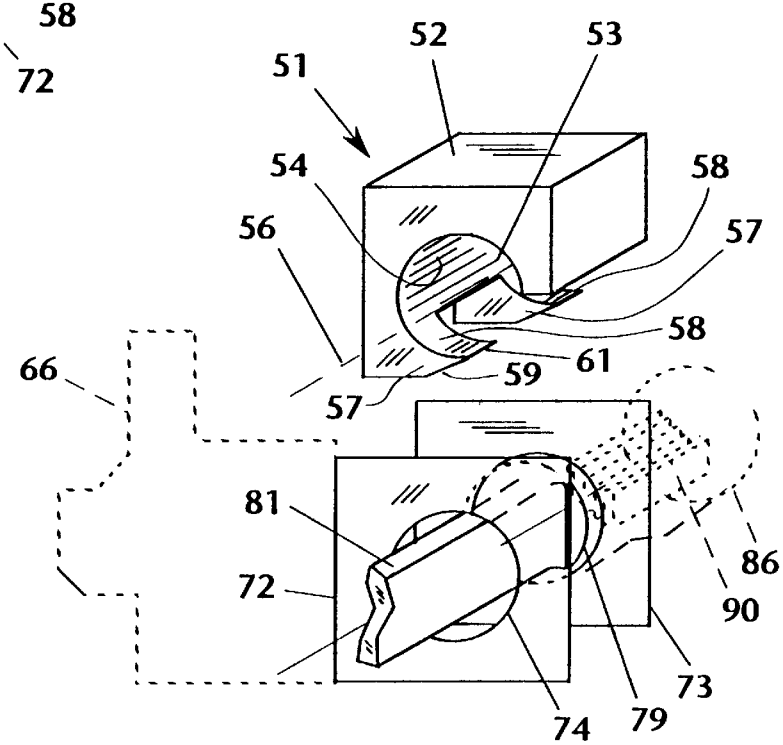
FIG. 14 is a perspective view of the scoop as in FIGS. 11–13, showing the scoop translated vertically out of engagement with the extended plunger.

The rear platen portion 34 is provided with a pair of parallel channels 44 extending laterally and generally orthogonally to the surfaces 36 and 38. The channels are disposed to permit engagement and operation of a scoop assembly 50. With reference to FIG. 14, a salient feature of the scoop assembly 50 is a scoop 51, which includes a housing 52 having a collection chamber 53 formed therein. The collection chamber 53 includes a cylindrically curved sidewall 54 that defines the upper half of the chamber 53, the axis 56 of the cylindrical curvature extending generally parallel to the longitudinal direction of the platen surfaces 36 and 38. A pair of fingers 57 extend downwardly from the housing 52, the fingers 57 being spaced apart at longitudinally opposed ends of the scoop. The fingers include inner surfaces 58 that extend continuously with the curved surface 54 and are likewise a portion of a cylinder of the same radius. The outer surfaces 59 of the fingers taper upwardly to define with the inner surface a vertex 61. The presence and conformation of the fingers 57 define lower end openings of the chamber 53 that subtend an angle of approximately 90°, whereas the medial portion of the chamber 53 has a lower opening of approximately 180°. It is significant to note that the fingers 57 are dimensioned and spaced appropriately to extend into and translate along the two channels 44 in the rear platen 34.

Figure 10:
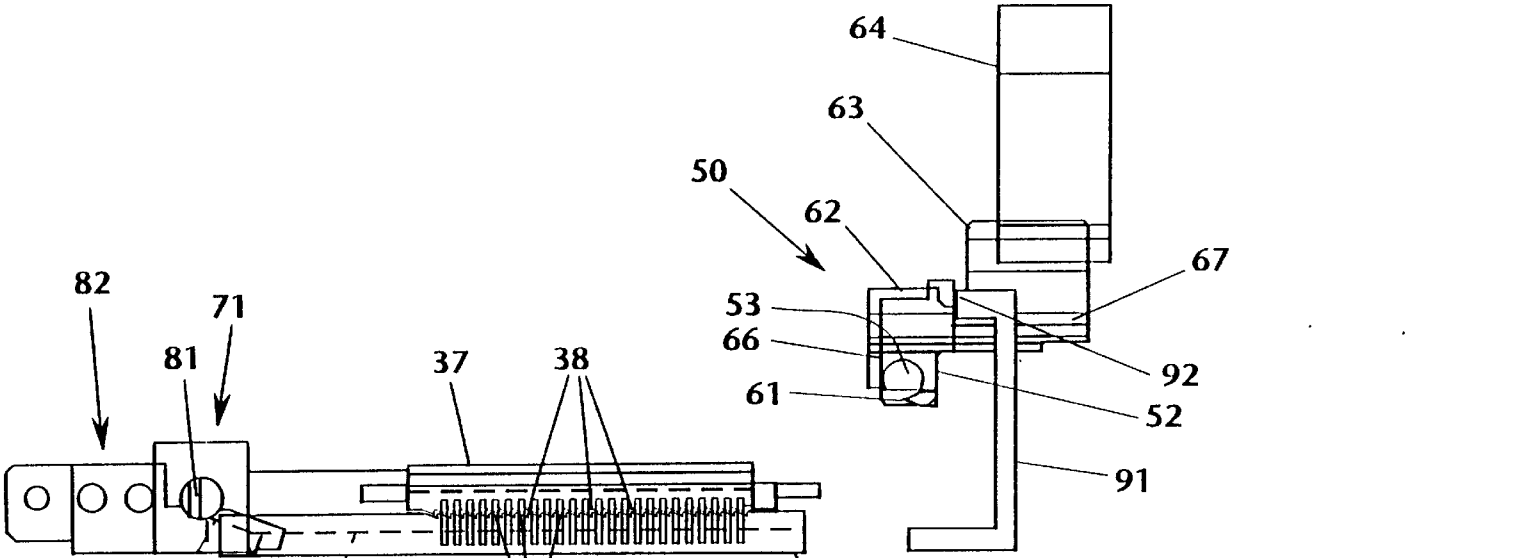
FIG. 10 is a front elevation of the apparatus of FIGS. 6–9, showing the scoop assembly translated in the raised disposition to the start position.

The scoop housing 52 is secured to a bracket 62, which in turn is supported by an actuator 63 adapted selectively to translate vertically and reciprocally. The actuator 63 is secured to an actuator 64 that is adapted selectively to translate laterally and reciprocally, so that the scoop assembly may be moved laterally across the rear platen 34, both in the vertically raised and lowered disposition, as will be described below. The scoop assembly also includes a shutter 66, comprising a flat panel slidably supported in a track 67 in the bracket 62. The shutter is adapted to translate laterally with respect to the bracket 62, so that the shutter 66 may be moved into a closure position in which it occludes one end of the collection chamber 53, as shown in FIGS. 6 and 10, or moved into a disengaged position in which the end of the collection chamber 53 is open, as shutter is disposed to interact with the chamber end adjacent to the fixed top plate 37, as shown in FIG. 4.

A further aspect of the invention is the provision of a packing assembly 71 for removing the collected strips from the scoop assembly 50 and placing the strips in an appropriate container. As best shown in FIGS. 1–3 and 11–14, the packing assembly 71 includes paired front and back panels 72 and 73 disposed in parallel, spaced apart fashion at the terminations 75 of the channels 44. A pair of circular openings 74 and 76 are formed in the panels 72 and 73, respectively, and are disposed in axial alignment. The panels define therebetween a loading station 77 adapted to receive the housing 52 of the scoop assembly 50. The packing assembly 71 further includes a plunger 78 having a disk-like head 79 and a narrow piston rod 81 disposed in eccentric relationship to the head 79. The head 79 is aligned and dimensioned to extend through the circular openings 74 and 76, and the piston rod 81 is offset laterally with respect to the axial alignment of the openings 74 and 76. The piston rod 81 is connected to a linear actuator mechanism 82, whereby the plunger 78 may re translated reciprocally through the opening 74, through the loading station 77, and through the opening 76. A fixture 84 is disposed at the outer surface of the panel 73, and is adapted to support a container 86 with the opening thereof in alignment with the opening 76 for receiving a plurality of the collected strips.

Figure 1:
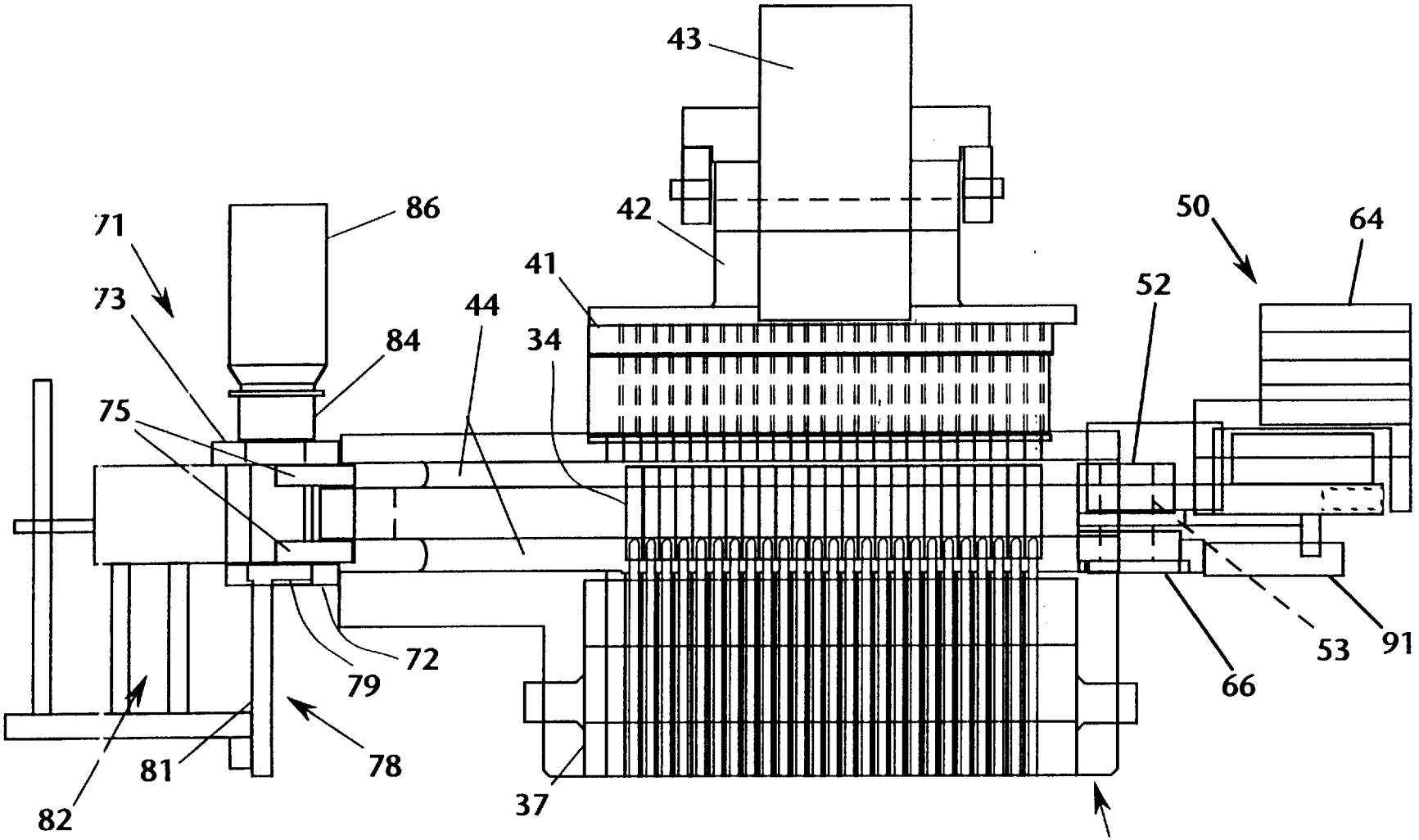
FIG. 1 is a plan view of the apparatus of the present invention shown in the starting position for collecting and packaging cut strips.

The operation of the invention involves sequential operation of the components described above. With reference to FIGS. 1, 4, and 10, the sequence begins with the scoop assembly retracted out of engagement with the rear platen portion 34, the scoop shutter 66 closed, the top containment plate 41 extended over the rear platen portion 34, and the plunger 78 retracted. A card 27 is fed into the rotary cutting assembly 21, creating a plurality of strips that fall onto the surfaces 36 of the platen portion 32. The strips are then moved to the rear platen portion 34 under the top containment plate 41.

Figure 2:
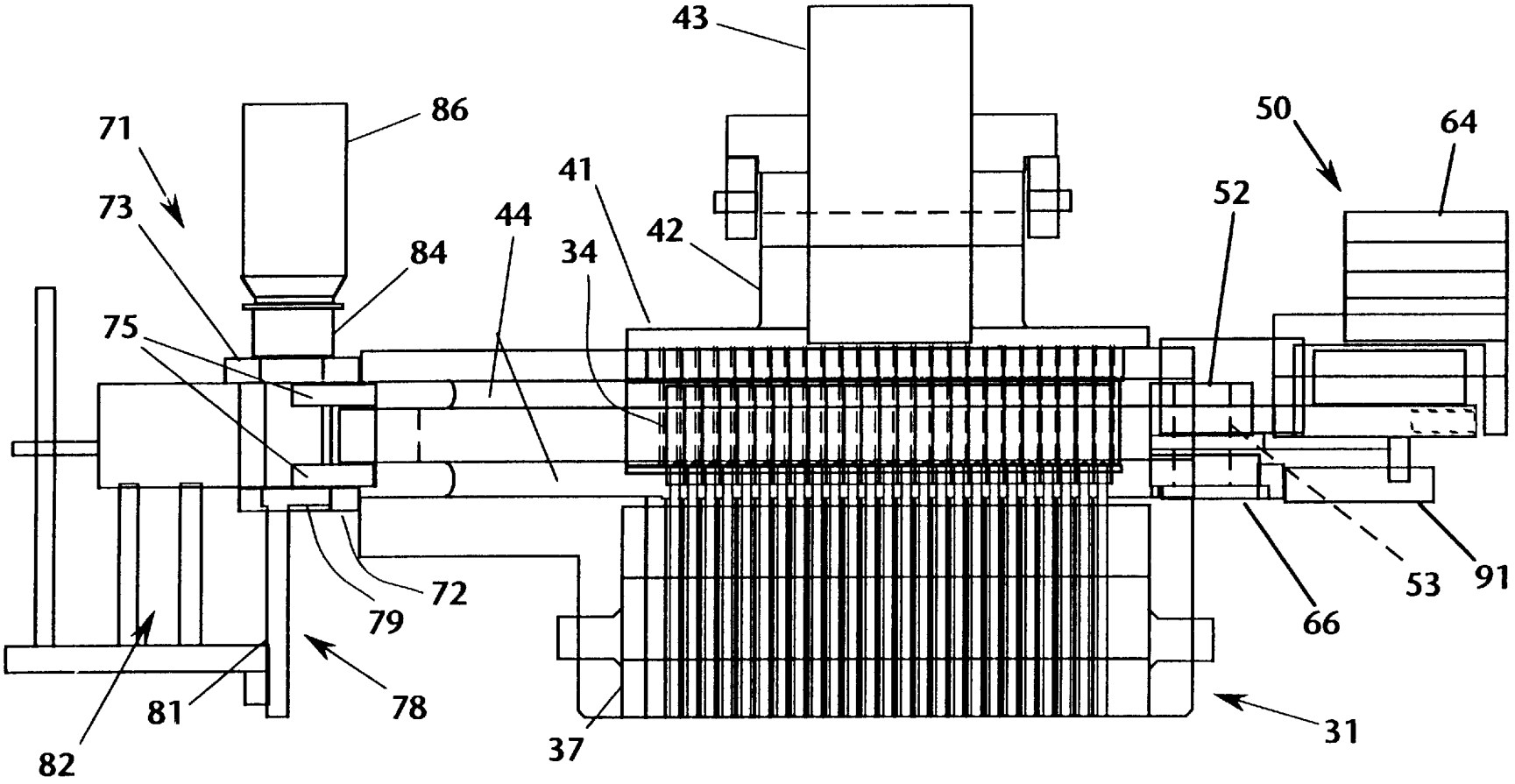
FIG. 2 is a plan view of the apparatus of FIG. 1, shown with the top containment device retracted.
Figure 5:
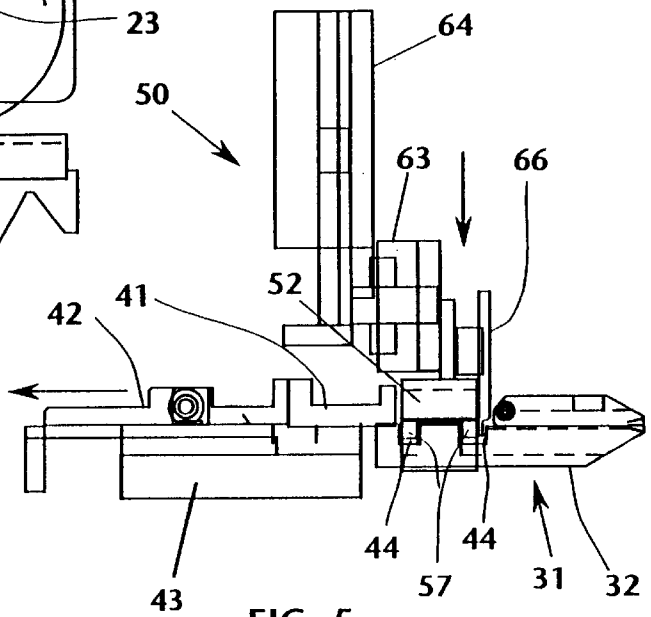
FIG. 5 is an end elevation of the apparatus of the present invention, shown with the top containment device retracted and the scoop assembly extended vertically downwardly.
Figure 6:
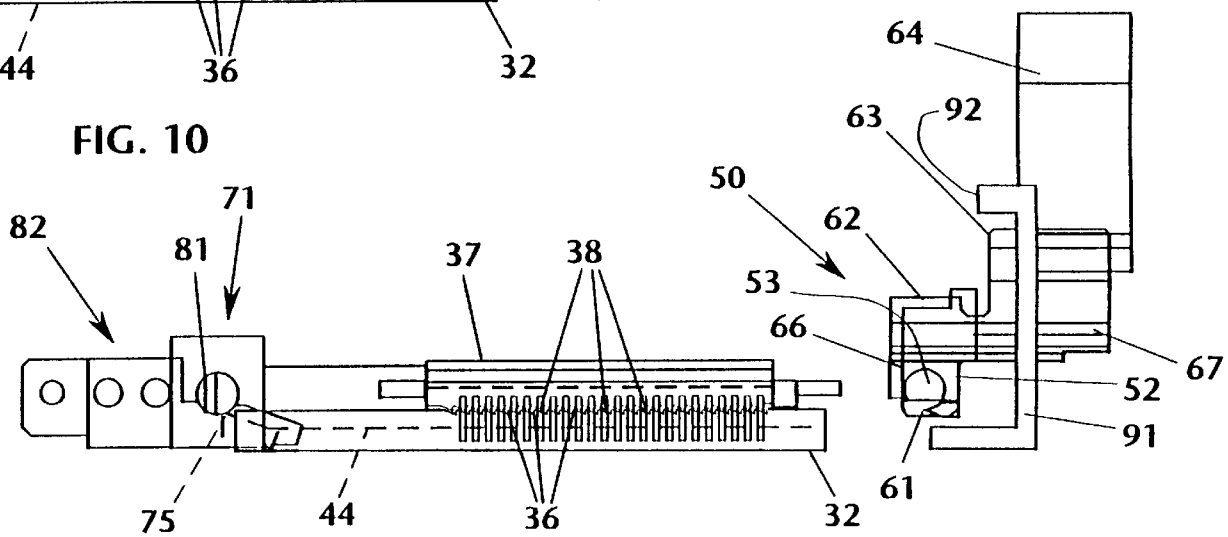
FIG. 6 is a front elevation of the apparatus of the invention, shown at the starting position for collecting and packaging cut strips.
Figure 7:
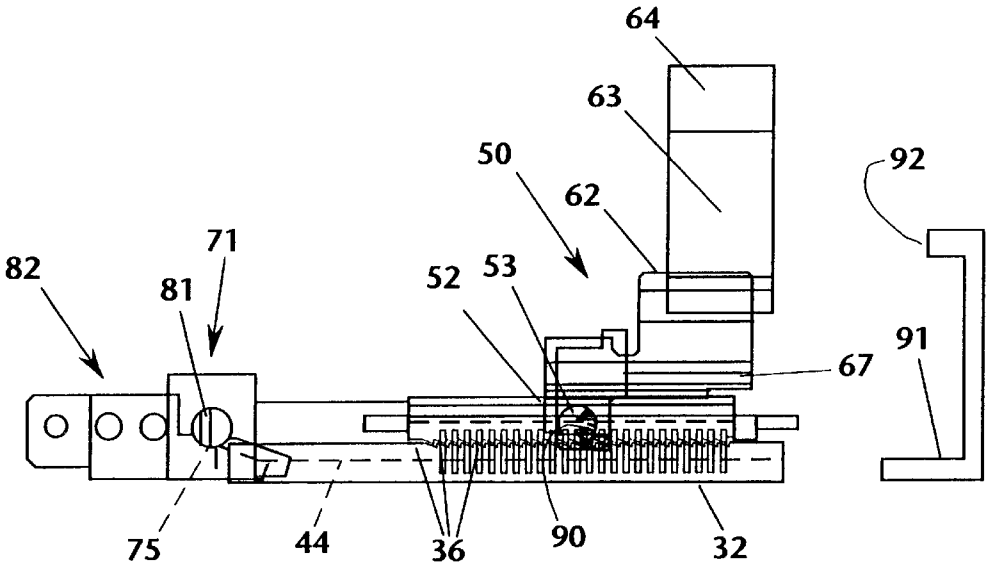
FIG. 7 is a front elevation of the apparatus of FIG. 6, showing the scoop assembly partially translated across the platen.

With reference to FIGS. 2, 5, and 6, the scoop assembly 50 is extended vertically downwardly, while the top containment plate 41 is retracted longitudinally to expose the strips on the rear platen portion 34. As shown in FIG. 7, the scoop assembly 50 then translates laterally across the rear platen portion 34, the fingers 57 traveling in the channels 44 to lift the strips from the surfaces 36 of the platen and scoop them into the chamber 53 of the housing 52. The strips tend to accumulate in a bundle that gradually grows and fills the chamber 53 as the scoop progresses across the platen.

Figure 3:
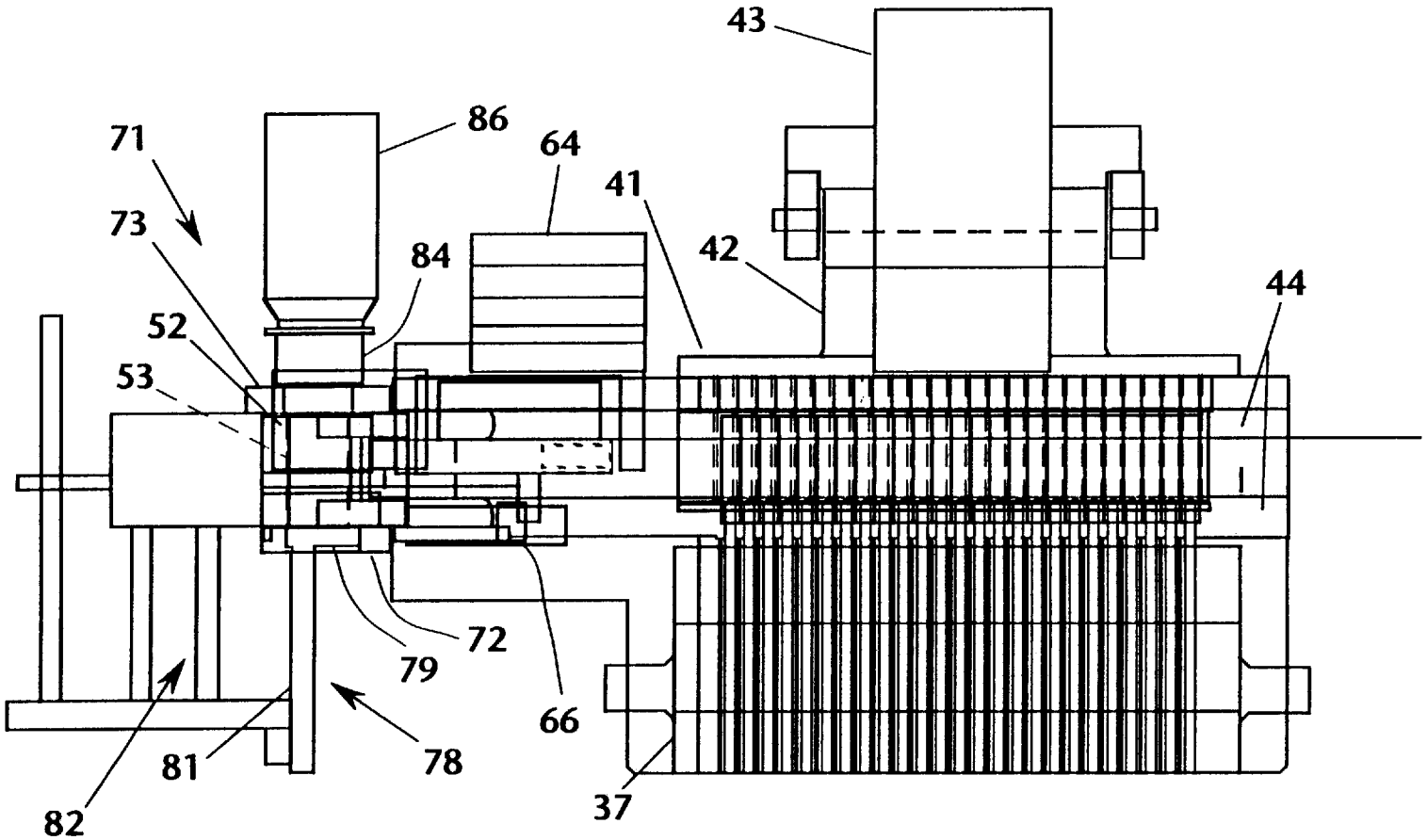
FIG. 3 is a plan view of the apparatus of FIGS. 1 and 2, shown with the scoop assembly translated to the packing station and the top containment device extended.
Figure 8:
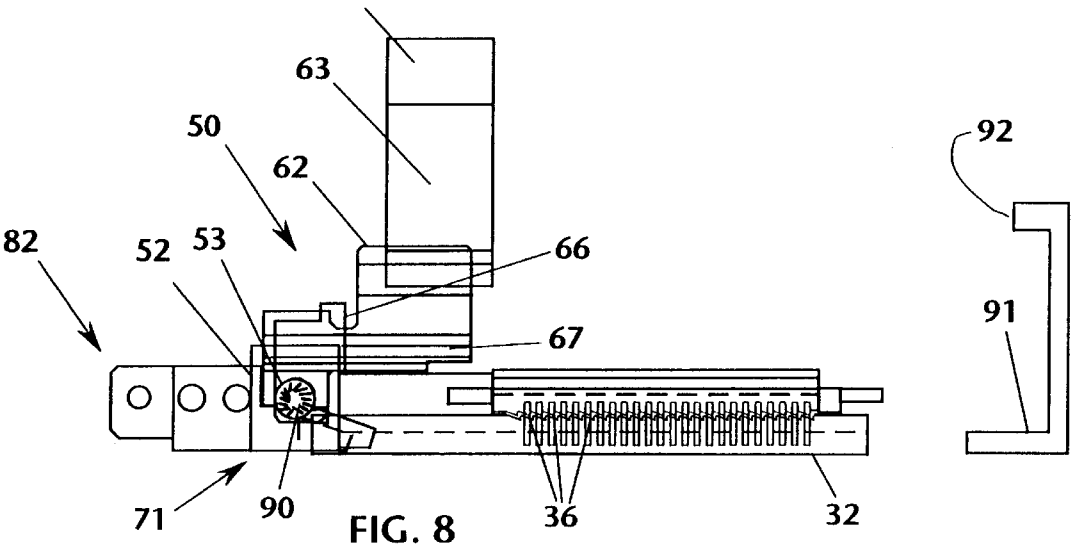
FIG. 8 is a front elevation of the apparatus of FIGS. 6 and 7, showing the scoop assembly disposed at the packing station.
Figure 11:
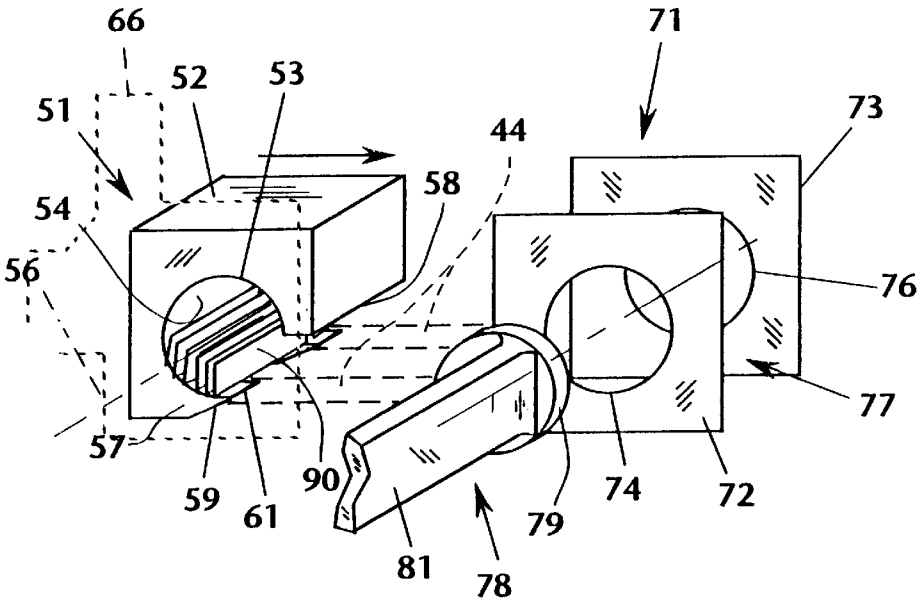
FIG. 11 is a perspective view of the scoop of the present invention containing a plurality of strips and approaching engagement with the packing assembly.
Figure 12:
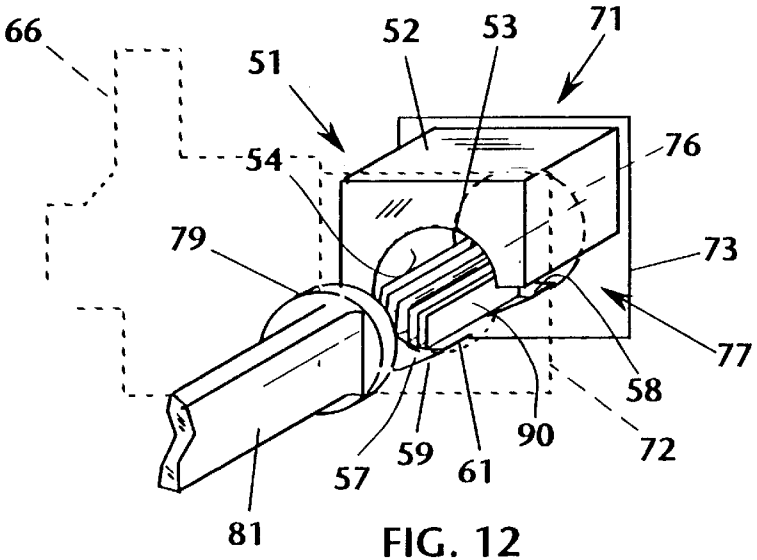
FIG. 12 is a perspective view of the scoop as in FIG. 11, with the front panel in phantom line to show the scoop fully engaged with the packing assembly.

The scoop assembly translates to the packing station 71, as shown in FIGS. 8 and 11. As the scoop assembly passes the front panel 72, the shutter 66 impinges on the panel 72 and is blocked from further translation, while the housing 52 continues to translate, whereby the shutter is moved relatively to open the end of the chamber 53 that is adjacent to the plunger 78, as shown in FIGS. 3 and 12. The housing 52 is stopped at the loading station 77 with the axis of the chamber 53 generally aligned with the openings 74 and 76. At the same time, the top containment plate 41 is extended to cover the rear platen portion 34 to prepare to receive a subsequent batch of strips.

Figure 9:
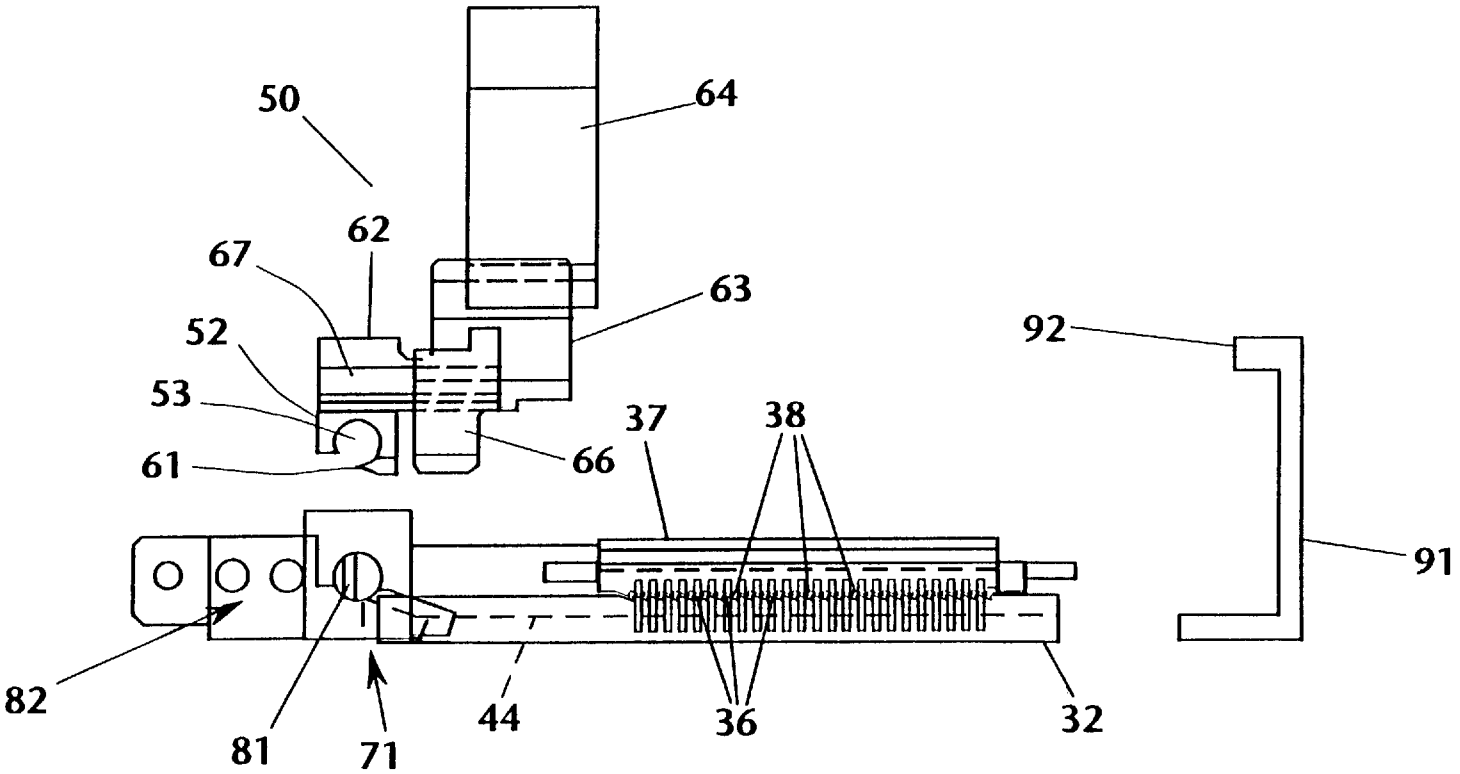
FIG. 9 is a front elevation of the apparatus of FIGS. 6–8, showing the scoop assembly raised vertically above the packing station.
Figure 13:
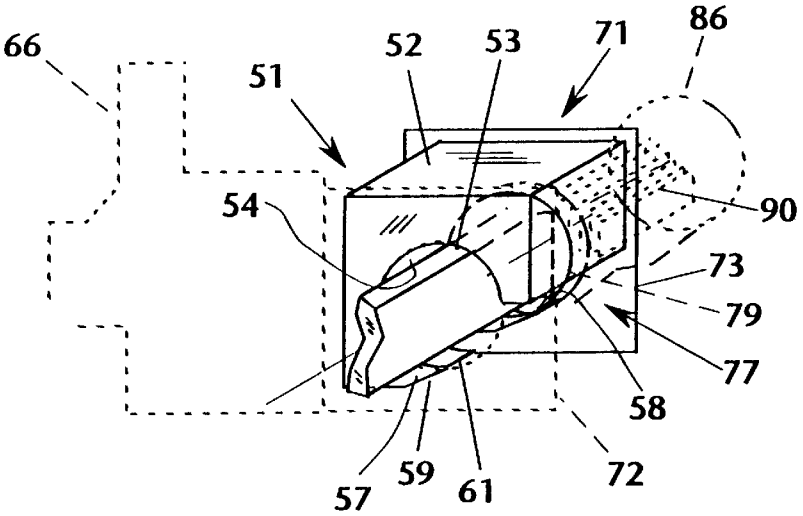
FIG. 13 is a perspective view of the scoop as in FIGS. 11 and 12, showing the plunger of the packing assembly fully extended to eject the plurality of strips from the scoop.

Thereafter, the linear actuator mechanism 82 is activated to translate the plunger 78 through the chamber 53, pushing the accumulated strips 90 into the container 86, as shown in FIG. 13. While the plunger 78 is extended, the housing 52 is translated vertically upwardly, as shown in FIGS. 9 and 14, to prepare to translate retrograde over the rear platen portion 34 while the top containment plate 41 is extended. It may be noted that the eccentrically located piston rod 81 is disposed to pass through the bottom opening of the chamber 53 as the housing 52 moves upwardly. The top containment plate 41 holds the next batch of strips on the platen and prevents air currents or static charges from the retrograde translating scoop assembly 50 from disrupting the orderly array of strips on the surfaces 36 of the platen. The plunger is then retracted, and an empty container replaces the filled container 86.

As the scoop assembly arrives at the starting position (FIG. 10), the open shutter 66 impinges on a stop 92 of a bracket 91, preventing further translation of the shutter 66. As the scoop assembly continues to move retrograde, the shutter is moved relatively thereto to resume a closed position with respect to the chamber 52, as shown in FIG. 10. The scoop assembly is thus prepared for the subsequent collection cycle, as is the top containment plate 41 and the packing assembly 71.

It may be noted that the timing of the sequential steps described herein may be set to maximize the output of the overall machine. In addition, the packing assembly may be arranged so that the plunger translates in the same direction as the strips move onto the platen, as depicted, or so that the plunger translates in the opposite direction as the strips movements. The important consideration is that the shutter 66 is placed at the end of the scoop housing 52 that the plunger will enter first, so that the plunger will impinge on the strips with well-distributed force and velocity. Likewise, the collection chamber, which is described herein as hemicylindrical, may be formed with any similar closed curved conformation, such as any of the conic sections, or non-regular curvatures.

In the description of the preferred embodiment certain actuators and mechanisms, such as the linear actuators that translate the scoop assembly vertically and laterally, the actuators that translate the plunger and the movable top containment plate, and the mechanism for moving the cut strips from the intake portion 32 to the collection portion 34 of the platen, have been referred to generically. Such devices may include any appropriate mechanisms known in the prior art, including linear stepped actuators, programmed robotic actuators, chain or belt drives, pneumatic actuators, and the like.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

We claim:

1. Apparatus for collecting and packaging a plurality of strips issuing from a strip-forming cutter, including:

a platen disposed adjacent to the cutter, said platen including an intake portion and a collection portion;

said platen including a first plurality of parallel stepped surfaces for receiving the plurality of strips from the cutter;

scoop means for gathering the plurality of strips on said parallel stepped surface; and packaging means for moving said stack from said scoop means into a packing container.

2. The apparatus of claim 1, wherein said scoop means includes a collection chamber, said collection chamber having a closed curved upper sidewall.

3. The apparatus of claim 2, wherein said closed curved sidewall extends along a first axis of symmetry, said first axis of symmetry being generally parallel to said parallel stepped surfaces.

4. The apparatus of claim 3, wherein said collection chamber includes a lower opening extending generally parallel to said first axis of symmetry.

5. The apparatus of claim 4, further including a pair of fingers extending from said scoop means partially into said lower opening.

6. The apparatus of claim 5, wherein said pair of fingers are spaced apart along said first axis.

7. The apparatus of claim 5, wherein said pair of fingers include interior surfaces extending contiguously with said closed curved upper sidewall.

8. The apparatus of claim 5, further including a pair of channels extending laterally in said collection portion of said platen, said pair of channels traversing said parallel stepped surfaces.

9. The apparatus of claim 8, wherein said pair of fingers are disposed to be received in said pair of channels in freely translating fashion.

10. The apparatus of claim 9, further including means for translating said collection chamber laterally and reciprocally to translate said pair of fingers along said pair of channels and scoop the plurality of strips from said parallel stepped surfaces into said collection chamber.

11. The apparatus of claim 5, further including shutter means for selectively blocking said at least one end opening.

12. The apparatus of claim 11, wherein said shutter means includes a panel extending to intersect said first axis of symmetry, and means for translating said panel to open and close said at least one end opening.

13. The apparatus of claim 4, wherein said collection chamber includes at least one end opening disposed at one end of said closed curved sidewall.

14. The apparatus of claim 1, further including fixed top containment means extending vertically adjacent to said intake portion of said platen.

15. The apparatus of claim 1, further including movable top containment means extending vertically adjacent to said collection portion of said platen.

16. The apparatus of claim 15, wherein said movable top containment means includes a top plate, a second plurality of parallel stepped surfaces extending in said top plate in complementary spaced apart fashion to said first plurality of parallel stepped surfaces.

17. The apparatus of claim 16, further including means for translating said movable top containment plate longitudinally and reciprocally in a direction parallel to said first and second pluralities of stepped surfaces.

18. The apparatus of claim 1, wherein said scoop means includes a collection chamber, said collection chamber having a lower opening and a pair of spaced apart fingers extending partially into said lower opening.

19. The apparatus of claim 18, wherein said collection portion of said platen includes a pair of channels extending therein and intersecting said first plurality of parallel stepped surfaces.

20. The apparatus of claim 19, further including means for translating said scoop means vertically and reciprocally from a first vertical position in which said scoop means is spaced apart from said platen, to a second vertical position in which said scoop means is adjacent to said platen and said pair of fingers extend into said pair of channels.

21. The apparatus of claim 20, further including means for translating said scoop means laterally and reciprocally from a first lateral position in which said scoop means is disposed at one end of said platen, to a second lateral position in which said scoop means is disposed to engage said packaging means, said scoop means thereby traversing said platen with said pair of fingers extended into said pair of channels.

22. The apparatus of claim 1, wherein said scoop means includes a collection chamber, said collection chamber including a pair of opposed end openings.

23. The apparatus of claim 22, wherein said packaging means includes a plunger assembly, means for moving said plunger assembly reciprocally to extend through said pair of opposed ends and push said plurality of strips from said collection chamber.

24. The apparatus of claim 23, wherein said packaging means includes means for supporting an empty container having a container opening adjacent to one of said pair of opposed ends to receive said plurality of strips.

* * * * *

UNITED STATES PATENT AND TRADEMARK OFFICE
Certificate

Patent No. 5,816,030 Patented: October 6, 1998

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: David L. Carlberg, Twain Harte, CA; Dennis L. May, Twain Harte, CA; Theodore V. Meigs, Twain Harte, CA; and Ford Garratt, Twain Harte, CA.

Signed and Sealed this Twenty-seventh Day of January 2004.

RINALDI RADA
*Supervisory Patent Examiner*
Art Unit 3721